US009263214B2

(12) United States Patent
Trant

(10) Patent No.: US 9,263,214 B2
(45) Date of Patent: Feb. 16, 2016

(54) MAKE-UP AIR INTAKE SYSTEM

(75) Inventor: Nathan D. Trant, Rockwall, TX (US)

(73) Assignee: CCB Innovations, LLC, Rockwall, TX (US)

( * ) Notice: Subject to any disclaimer, the term of this patent is extended or adjusted under 35 U.S.C. 154(b) by 782 days.

(21) Appl. No.: 13/612,612

(22) Filed: Sep. 12, 2012

(65) Prior Publication Data

US 2013/0072102 A1 Mar. 21, 2013

Related U.S. Application Data

(60) Provisional application No. 61/534,934, filed on Sep. 15, 2011.

(51) Int. Cl.

| | |
|---|---|
| ***F24F 7/04*** | (2006.01) |
| ***H01H 35/26*** | (2006.01) |
| *F24F 11/04* | (2006.01) |
| *F24F 11/00* | (2006.01) |

(52) U.S. Cl.

CPC ..... *H01H 35/2657* (2013.01); *F24F 11/04* (2013.01); *F24F 2011/0002* (2013.01); *Y10T 29/49826* (2015.01)

(58) Field of Classification Search

CPC ..... F24F 11/04; F24F 2011/0002; F24F 13/1413; H01H 35/2657; Y10T 29/49826

USPC ..... 454/8, 9, 20, 30, 56, 58, 61, 64, 237, 454/238, 241, 252, 358, 360, 370; 73/1.23; 200/81 R, 81.9 R

See application file for complete search history.

(56) References Cited

U.S. PATENT DOCUMENTS

| | | | | |
|---|---|---|---|---|
| 2,276,100 | A * | 3/1942 | Scholin | 200/81.9 R |
| 2,788,411 | A * | 4/1957 | Porwancher | H01H 35/24 200/81 R |
| 3,008,699 | A * | 11/1961 | Richterkessing et al. | 432/47 |
| 3,119,979 | A * | 1/1964 | Martin | B60Q 1/44 180/309 |
| 3,501,605 | A * | 3/1970 | Hutchinson et al. | 200/81.9 R |
| 4,454,768 | A * | 6/1984 | Nansel | 73/861.76 |
| 4,725,700 | A * | 2/1988 | Zoludow | 200/81.9 R |
| 6,170,480 | B1 * | 1/2001 | Melink et al. | 126/299 R |
| 2009/0093210 | A1 * | 4/2009 | Livchak et al. | 454/363 |
| 2012/0282853 | A1 * | 11/2012 | Sinur et al. | 454/238 |

* cited by examiner

*Primary Examiner* — Gregory Huson
*Assistant Examiner* — Dana Tighe
(74) *Attorney, Agent, or Firm* — Conley Rose, P.C.; William H. Dietrich

(57) ABSTRACT

An embodiment make-up air system includes a switch assembly including a housing configured to be mounted to an exhaust air duct, a rod pivotally mounted to the housing, the rod having a paddle mounted on a first rod end disposed outside the housing, the paddle including an angled portion, and a switch disposed in the housing, the switch actuated by the rod when the paddle experiences a predetermined flow of air through the exhaust duct, and a fresh air intake assembly operably coupled to the switch assembly, the fresh air intake assembly configured to open a damper disposed in a fresh air intake duct to initiate a flow of fresh air when the switch in the switch assembly has been actuated.

15 Claims, 3 Drawing Sheets

FIG. 4
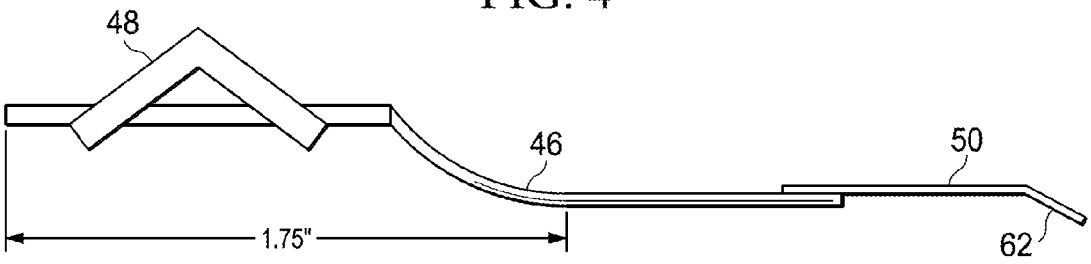
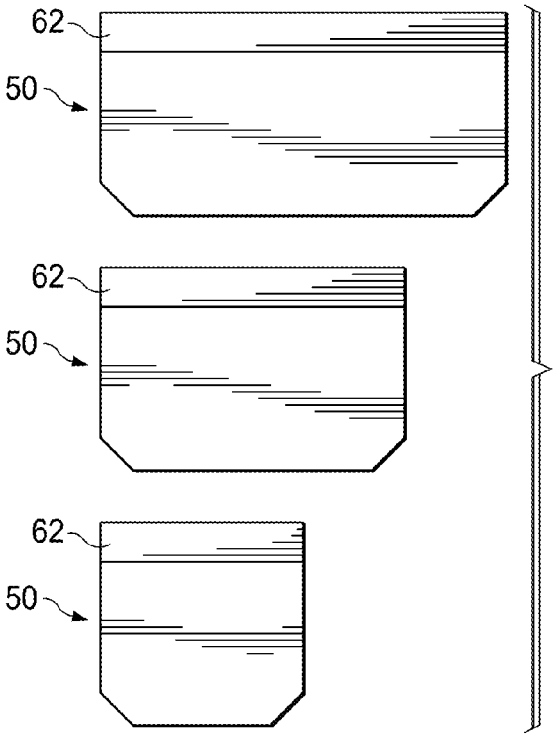
FIG. 5

MAKE-UP AIR INTAKE SYSTEM

This application claims the benefit of the following provisionally filed U.S. Patent application: Application Ser. No. 61/534,934, filed Sep. 15, 2011, and entitled "Make-Up Air System;" which application is hereby incorporated herein by reference.

BACKGROUND

Construction technology has succeeded in developing a more sealed and energy efficient structure (e.g., residential dwelling, office building, etc.). Internal air, which once escaped from the structure through cracks around windows and doors and elsewhere, is now trapped within the structure. As a result, negative air pressure can be generated inside the structure in some circumstances. The negative air pressure may, in some circumstances, result in air being drawn into the structure in a manner that is unintended or unsafe. Therefore, even though the tightly sealed structure may save energy and be less costly to own, the resultant negative air pressure caused thereby may lead to undesirable side effects.

BRIEF DESCRIPTION OF THE DRAWINGS

For a more complete understanding of the present disclosure, and the advantages thereof, reference is now made to the following descriptions taken in conjunction with the accompanying drawings, in which:

FIG. 4 is a steel rod actuator from the switch assembly of FIG. 1; and

FIG. 5 is a top view of different paddles suitable for use with the steel rod actuator of FIG. 4 in the switch assembly of FIG. 1.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present disclosure provides many applicable inventive concepts that can be embodied in a wide variety of specific contexts. The specific embodiments discussed are merely illustrative and do not limit the scope of the disclosure.

The present disclosure will be described with respect to preferred embodiments in a specific context, namely a make-up air intake system. The concepts in the disclosure may also apply, however, to other air or ventilation systems.

Figure 1:
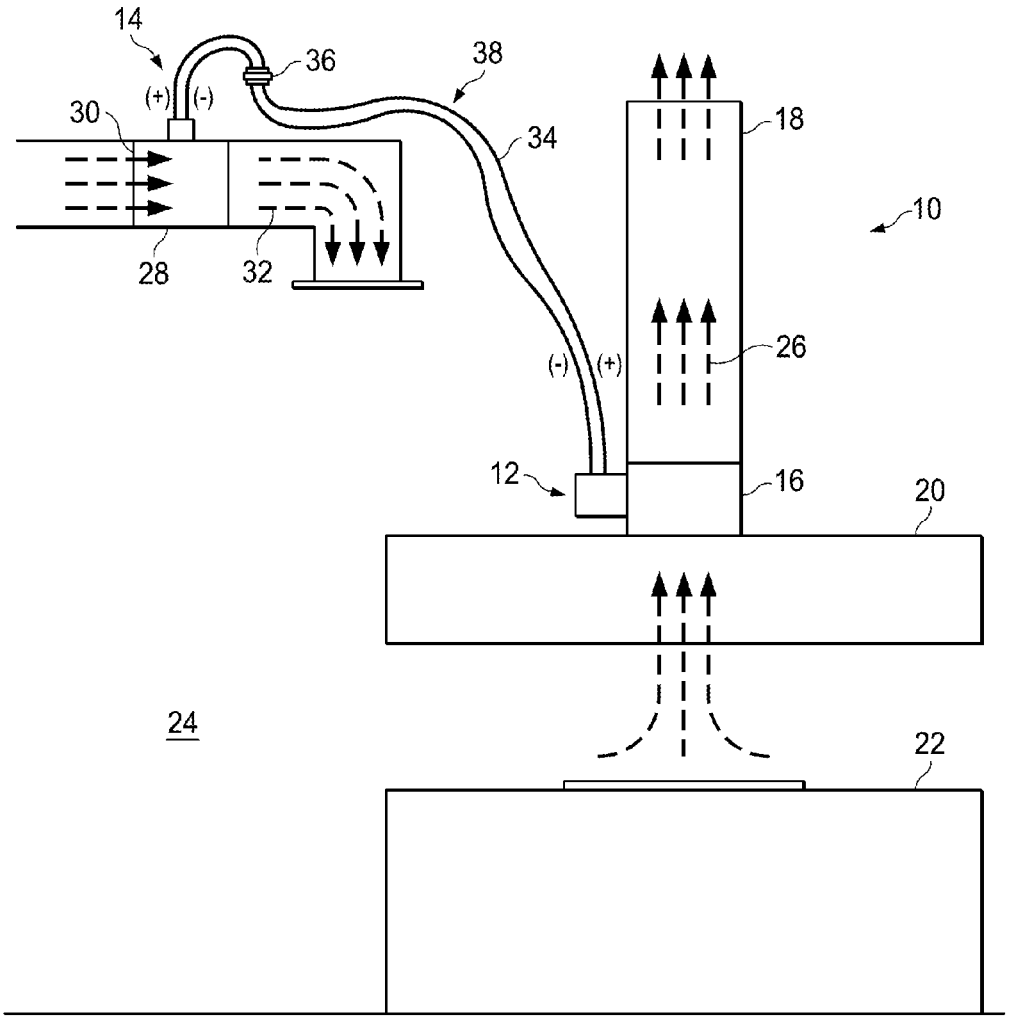
FIG. 1 is a simplified schematic of a make-up air intake system.

Referring now to FIG. 1, a make-up air intake system 10 (a.k.a., a fresh air system) is illustrated. As will be more fully explained below, the make-up air intake system 10 introduces fresh air into a structure in order to eliminate or reduce the negative air pressure generated by a residential exhaust system. As shown in FIG. 1, the make-up air intake system 10 comprises a switch assembly 12 operably coupled to a make-up air intake assembly 14 (a.k.a., fresh air intake assembly).

Still referring to FIG. 1, the switch assembly 12 is configured to be mounted to a duct collar 16. As shown, the duct collar 16 is disposed between exhaust ducting 18, which provides communication with ambient air outside the structure, and a high cubic feet per minute (CFM) exhaust system 20, which is disposed above a cooking surface 22 in a residential kitchen 24. In some embodiments the exhaust system 20 is a four hundred CFM or greater system. As shown, when the exhaust system 20 is operating a flow of air 26 is established from within the kitchen 24, through the duct collar 16 and by the switch assembly 12, and out of the structure. In some embodiments, the switch assembly 12 is electrically coupled to, and powered by, a standard 110/120 V AC power source.

As shown, the air intake assembly 14 is configured to be mounted to a fresh air intake duct 28. When a motorized damper 30 of the air intake assembly 14 is in an open position, a flow of air 32 is established from outside the structure, through the fresh air duct 28, and into the kitchen 24. When the motorized damper 30 is in a closed position, the flow of air 32 into the kitchen is terminated. In some embodiments, the air intake assembly 14 is located proximate or near the exhaust system 20.

In some embodiments, the switch assembly 12 is electrically coupled to the make-up air intake assembly 14 via electrical wiring 34. While the electrical wiring 34 is visible in FIG. 1, the electrical wiring 34 is typically hidden behind or routed along, for example, the walls or ceiling of the residential kitchen 24. In an embodiment, the switch assembly 12 is coupled to the air intake assembly 14 through wireless communication. In such embodiments, the switch assembly 12 and the air intake assembly 14 are equipped with wireless communication equipment. In some embodiments, the air intake assembly 14 is electrically coupled to, and powered by, a standard 110/120 V AC power source. In addition, a low voltage transformer 36 may be placed in the circuit 38 between the air intake assembly 14 and the switch assembly 12 to step the voltage supplied to the motorized damper 30 down to 24 V DC.

Figure 2:
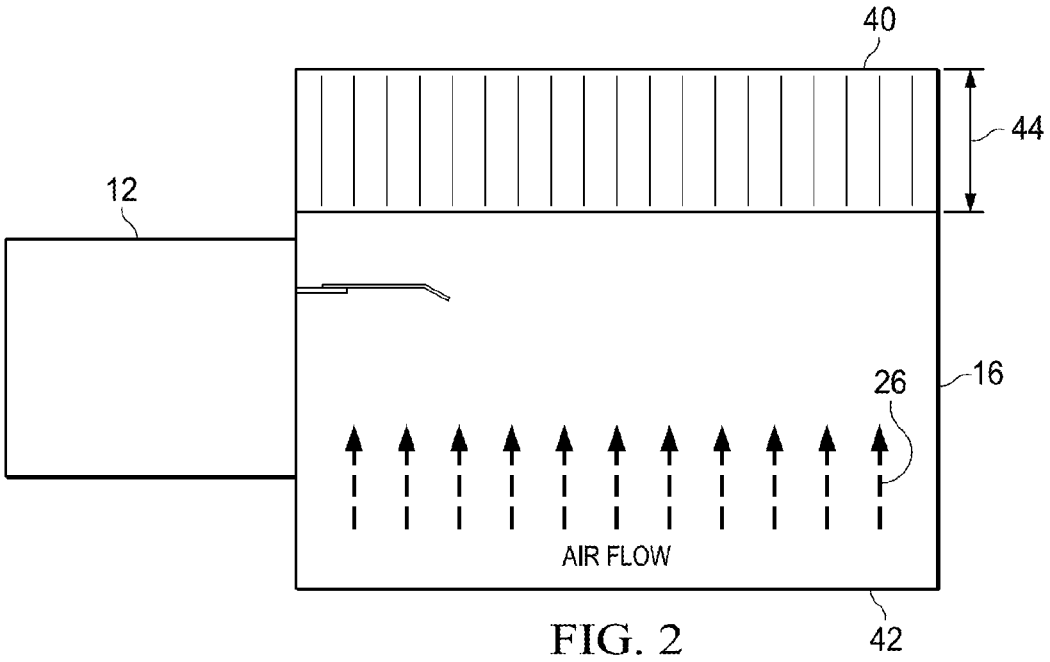
FIG. 2 is an elevation view of the switch assembly from the make-up air system of FIG. 1 mounted to a duct collar having a partially cut-away housing.

Referring now to FIG. 2, the duct collar 16 supporting the switch assembly 12 is highlighted. The duct collar 16 has a male end 40 and a female end 42. In some embodiments, the male and female ends 40, 42 of the duct collar 16 are at least one and a half inches in length 44. Also, in some embodiments the switch assembly 12 is mounted somewhere other than within the one and half inches from a terminal end of the duct collar 16.

Figure 3:
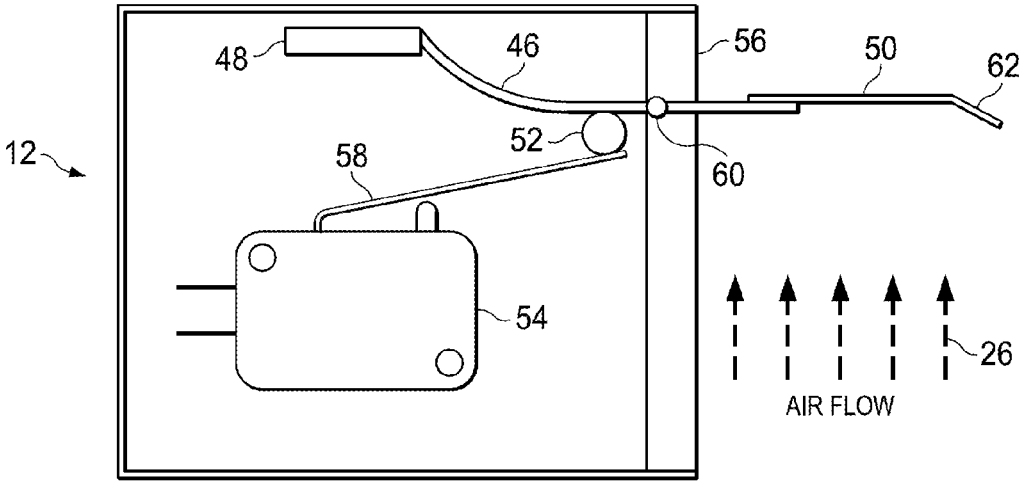
FIG. 3 is a partial cut-away view of the switch assembly of FIG. 1 illustrating internal components thereof.

Moving to FIG. 3, the switch assembly 12 is highlighted. The switch assembly 12 includes a curved steel rod 46, a counter weight 48, a paddle 50, a nylon roller pin 52, an a single pole micro switch 54. As shown, the rod 46 passes through a switch assembly housing 56 and generally supports the counter weight 48 and the paddle 50. The roller pin 52 is interposed between the rod 46 and the trigger arm 58 of the micro switch 54. Therefore, when the paddle 50 is biased upwardly by the flow of air 26, the rod 46 pivots about pivot point 60 and rolls on the roller pin 52. As the rod 46 rolls, the trigger arm 58 of the micro switch 54 is biased downwardly. When biased downwardly a sufficient amount, the trigger arm 58 actuates the micro switch 54. In contrast, when the paddle 50 is not biased upwardly by the flow of air 26 and is in the resting position (as shown in FIG. 3), the trigger arm 58 is raised and the micro switch 54 is not actuated.

In some embodiments, the micro switch 54 is actuated when the paddle 50 encounters or experiences a flow of air 26 in the duct collar 16 in a range of about one hundred and fifty to about two hundred and fifty CFMs. Even so, in other embodiments the switch assembly 12 may be calibrated or constructed such that either a greater or lesser flow of air 26 is sufficient to actuate the micro switch 54.

Referring now to FIGS. 4-5, the rod 46 and the paddle 50 from the switch assembly 12 are highlighted, respectively. As shown in FIG. 4, in some embodiments the rod 46 is curved to reduce the friction on the roller pin 52. Also, a portion of the rod 46 up to where the rod attaches is about one and three quarters inches long. In addition, as shown in FIGS. 3-5, in some embodiments the paddle 50 is provided with an angled portion 62 at its distal end to increase capture of the upward flow of air 26. As used herein, the angled portion 62 encompasses a paddle end that is angled, rounded, and otherwise non-linear. As shown in FIG. 5, the paddle 50 may be a variety of different sizes and dimensions. In some embodiments, the paddle 50 is formed from stainless steel, aluminum, tin, or an alloy thereof. Because of the negligible difference in weight of these paddles 50, the counter weight 48 may remain the same and need not be changed for one providing more or less weight.

In operation, when the exhaust system 20 of FIG. 1 is actuated and causes the flow of air 26 to reach a sufficient level, the paddle 50 of the switch assembly 12 is biased upwardly and the switch assembly 12 is actuated. The actuated switch assembly 12 signals the air intake assembly 14, via electrical wire 34 or otherwise, to open the damper 30 and permit the flow of air 32 into the kitchen 24 from outside the structure. In other words, actuation of the exhaust system 20 by the flow of air 26 causes the simultaneous opening of the damper 30 from the intake system 14 such that negative pressure within the kitchen 24 and structure is eliminated or significantly reduced.

While the disclosure provides illustrative embodiments, this description is not intended to be construed in a limiting sense. Various modifications and combinations of the illustrative embodiments, as well as other embodiments, will be apparent to persons skilled in the art upon reference to the description. It is therefore intended that the appended claims encompass any such modifications or embodiments.

What is claimed is:

1. A switch assembly for a make-up air system, comprising:

a housing configured to be mounted to an exhaust air duct;

a rod pivotally mounted to the housing, the rod having a paddle mounted on a first rod end disposed outside the housing and a counter weight mounted on a second rod end, the paddle including an angled portion, the counter weight disposed within the housing and attached only to the second rod end; and a switch disposed in the housing and operably coupled to the rod, the switch configured to be actuated by contact with a curvature of the rod when the rod pivots in response to the paddle experiencing a flow of air through the exhaust air duct that exceeds a predetermined threshold, wherein the switch is configured to signal a fresh air intake assembly to provide a flow of fresh air when actuated, and wherein the angled portion of the paddle is configured to aid in capturing the flow of air through the exhaust duct.

2. The switch assembly of claim 1, wherein the paddle has a width of less than two inches and a length of less than one inch.

3. The switch assembly of claim 1, wherein the predetermined threshold is about 150 cubic feet per minute to about 250 cubic feet per minute.

4. The switch assembly of claim 1, wherein the paddle is formed from at least one of stainless steel, aluminum, tin, and an alloy thereof.

5. The switch assembly of claim 1, wherein the rod is a curved steel rod.

6. The switch assembly of claim 1, wherein a roller pin disposed in the housing is interposed between the rod and a trigger arm of the switch.

7. The switch assembly of claim 1, wherein a wireless communication device is operably coupled to the switch.

8. A make-up air system, comprising:

a switch assembly including:

a housing configured to be mounted to an exhaust air duct;

a rod pivotally mounted to the housing, the rod having a paddle mounted on a first rod end disposed outside the housing and a counter weight mounted on a second rod end, the paddle including an angled portion, the counter weight disposed within the housing and attached only to the second rod end, and a switch disposed in the housing and operably coupled to the rod, the switch configured to be actuated by contact with a curvature of the rod when the rod pivots in response to the paddle experiencing a flow of air through the exhaust air duct that exceeds a predetermined threshold; and a fresh air intake assembly operably coupled to the switch assembly, the fresh air intake assembly configured to open a damper disposed in a fresh air intake duct to initiate a flow of fresh air when the switch in the switch assembly has been actuated, wherein the angled portion of the paddle is configured to aid in capturing the flow of air through the exhaust duct.

9. The make-up air system of claim 8, wherein the paddle has a width of less than two inches and a length of less than one inch.

10. The make-up air system of claim 8, wherein the predetermined threshold is about 150 cubic feet per minute to about 250 cubic feet per minute.

11. The make-up air system of claim 8, wherein the switch assembly and the fresh air intake assembly each include wireless communication equipment.

12. A method of making a switch assembly, comprising:

forming a housing configured to be mounted to an exhaust air duct;

pivotally mounting a rod to the housing, the rod having a paddle mounted on a first rod end disposed outside the housing and a counter ight mounted on a second rod end, the paddle including an angled portion, the counter eight disposed within the housing and attached only to the second rod end; and mounting a switch to the housing, the switch configured to be actuated by contact with a curvature of the rod when the rod pivots in response to the paddle experiencing a flow of air through the exhaust duct that exceeds a predetermined threshold, wherein the switch is configured to signal a fresh air intake assembly to provide a flow of fresh air when actuated, and wherein the angled portion of the paddle is configured to aid in capturing the flow of air through the exhaust duct.

13. The method of claim 12, wherein the paddle has a width of less than two inches and a length of less than one inch and the predetermined threshold is about 150 cubic feet per minute to about 250 cubic feet per minute.

14. The method of claim 12, further comprising disposing a roller pin between the rod and a trigger arm of the switch.

15. The method of claim 12, further comprising operably coupling a wireless communication device to the switch.

* * * * *